US007216619B2

(12) United States Patent
Sugiura et al.

(10) Patent No.: US 7,216,619 B2
(45) Date of Patent: May 15, 2007

(54) ENGINE DECOMPRESSION MECHANISM

(75) Inventors: Toshikazu Sugiura, Shizuoka-ken (JP); Yuki Sagawa, Shizuoka-ken (JP)

(73) Assignee: Yamaha Motor Co., Ltd., Shizuoka-ken (JP)

( * ) Notice: Subject to any disclaimer, the term of this patent is extended or adjusted under 35 U.S.C. 154(b) by 0 days.

(21) Appl. No.: 11/219,539

(22) Filed: Sep. 2, 2005

(65) Prior Publication Data

US 2006/0048736 A1 Mar. 9, 2006

(30) Foreign Application Priority Data

Sep. 3, 2004 (JP) ..... 2004-256507

(51) Int. Cl.
*F01L 13/08* (2006.01)

(52) U.S. Cl. ..... 123/182.1

(58) Field of Classification Search ..... 123/185.1, 123/182.1

See application file for complete search history.

(56) References Cited

U.S. PATENT DOCUMENTS 3,511,219 A * 5/1970 Esty ..... 123/182.1
4,977,868 A * 12/1990 Holschuh ..... 123/182.1
5,402,759 A * 4/1995 Ding et al. ..... 123/182.1
5,816,208 A * 10/1998 Kimura ..... 123/182.1
6,073,599 A * 6/2000 Kimura ..... 123/182.1
6,250,271 B1 * 6/2001 Ikuma et al. ..... 123/182.1
6,269,786 B1 * 8/2001 Snyder et al. ..... 123/182.1
6,889,646 B2 * 5/2005 Kurokawa et al. ..... 123/182.1
6,899,073 B2 * 5/2005 Tsutsumi et al. ..... 123/182.1
2002/0157631 A1 * 10/2002 Kawamoto ..... 123/182.1
2004/0261744 A1 * 12/2004 Tsutsumi et al. ..... 123/182.1
2005/0161012 A1 * 7/2005 Maeda et al. ..... 123/182.1
2005/0178370 A1 * 8/2005 Kashima et al. ..... 123/182.1

FOREIGN PATENT DOCUMENTS

EP 1 070 833 A2 1/2001

* cited by examiner

*Primary Examiner*—Stephen K. Cronin
*Assistant Examiner*—Arnold Castro
(74) *Attorney, Agent, or Firm*—Knobbe, Martens, Olson & Bear, LLP

(57) ABSTRACT

An engine features a decompression mechanism that extends through a bore formed in a camshaft. The mechanism has an actuator that is formed of multiple shafts. The shafts are joined in the region of a decompression pin. The actuator rotates relative to the camshaft and the rotation drives translation of decompression pins in a radial direction of the camshaft.

19 Claims, 11 Drawing Sheets

(a)

(b)

ENGINE DECOMPRESSION MECHANISM

CROSS-REFERENCE TO RELATED APPLICATIONS

This application claims the priority benefit under 35 U.S.C. § 119 of Japanese Patent Application No. 2004-256507, which was filed on Sep. 3, 2004 and which is hereby incorporated by reference in its entirety.

BACKGROUND OF THE INVENTION

1. Field of the Invention

The present invention generally relates to engine decompressor arrangements that temporarily reduce compression pressure when an engine is started. More particularly, the present invention relates to such arrangements that facilitate generally synchronous decompression across multiple cylinders.

2. Description of the Related Art

Compression release mechanisms have been used in single and multiple cylinder engines to make the engines easier to start. For instance, European Published Patent Application No. EP 1 070 833 A2 describes one such mechanism. The mechanism disclosed in this publication uses a construction that opens an exhaust valve during a compression stroke.

The mechanism features a compression release shaft that extends in the axial direction of a valve system camshaft and one or more lift members that extend in the radial direction of the camshaft. The lift members selectively contact associated valve actuation devices such that the valves are lifted from the valve seats, which reduces the compression pressure developed within the combustion chamber.

The compression release shaft rotates within an axial bore formed in an end portion of the valve system camshaft. A driving unit, including a centrifugal weight and a return spring, is provided at one end of the compression release shaft and a cam for changing the position of each lift member is provided on the other end of the compression release shaft.

The centrifugal weight rotates radially outward under centrifugal force when the valve system camshaft rotates at a sufficiently high rotational speed. When the centrifugal weight swings outward, the compression release shaft, which is coupled for rotation with the centrifugal weight, rotates along its axis. The return spring of the driving unit urges the centrifugal weight inward (i.e., in a direction generally opposite to the movement caused by the centrifugal force). Thus, the return spring acts to return the centrifugal weight to its initial position and to rotate the compression release shaft in a direction opposite to that caused by the centrifugal movement of the centrifugal weight.

In other words, the compression release shaft is secured in a first position by the resilient force of the return spring until the valve system camshaft starts rotating. Once the valve system camshaft rotates at a sufficiently high speed, the centrifugal weight moves and rotates the compression release shaft to a second position.

The lift members are positioned within corresponding pin holes and can move in a radial direction of the camshaft. The pin holes are formed in such a way as to cross the through hole for the compression release shaft. A contact portion of the lift members protrudes from the camshaft at a location near the cam. The contact portion is designed to contact an exhaust valve and is formed on one end portion thereof with a weight being formed on the other end portion. The lift member extends more than halfway through the diameter of the camshaft. When the camshaft rotational speed increases, the centrifugal force applied to the weight end of the lift member increases, which ideally withdraws the lift member into the camshaft. Thus, as the rotational speed increases, the cam surface of the compression release shaft is moved to a position that no longer supports the lift members and the weighted end of the lift members reduces that degree to which the lift member protrudes from the camshaft.

In the following description, the position of the lift member where the exhaust valve is opened to reduce the compression pressure is referred to as a pressing position, and the position of the lift member where the engine is in the normal driving state is referred to as a non-pressing position. In the construction described directly above, the lift members are designed to move between positions solely by centrifugal force once the compression release shaft rotates into the position that no longer supports the lift members.

SUMMARY OF THE INVENTION

While allowing the movement to occur through centrifugal force would appear to be adequate, when a multi-cylinder engine is equipped with the above-mentioned construction, it is difficult to synchronize the movements of the pins of the cylinders. Hence, when the engine is started, cylinders reduced in compression pressure coexist with cylinders shifted to a normal driving state, which results unstable rotation of the engine. It appears that the centrifugal forces applied to the weights of the decompressor pins described above may not always exceed the frictional forces caused by foreign matter, such as particulate material entrained in lubricants, at the same time. In other words, different pins will need to overcome different frictional forces. In an extreme situation, the weight of the pin may not return the pin to the recessed position even with low speed operation of the engine and the associated cylinder may be faced with compression loss during operation.

Moreover, in the assembly described above, t is necessary to determine the outside diameter of a valve system camshaft, the amount of eccentricity of the decompressor shaft from the axis of this valve system camshaft, and the shape of the decompressor pin in such a way that the centrifugal force applied to the weight of the decompressor becomes an appropriate magnitude. For this reason, the angle of the decompressor pin when viewed from the axial direction of the valve system camshaft cannot be substantially varied between one cylinder and another cylinder. That is, in multi-cylinder engine applications, it is impossible to vary the phases of the exhaust cams of the respective cylinders provided on the valve system camshaft when viewed from the axial direction of the valve system camshaft to a large extent (for example, to vary the phase by 180 degrees), so that the multi-cylinder engine is subject to constraints in design.

The identification of these issues and others resulted in the development of a decompression mechanism having certain features, aspects and advantages of the present invention. For instance, an object of the present invention is to provide a decompression mechanism for an engine that can synchronize a plurality of decompression pins and provide a high degree of flexibility in designing the engine when the decompressor is mounted on a multi-cylinder engine.

Thus, one aspect of the present invention involves an engine with a decompression mechanism. The engine comprises a generally hollow camshaft. The camshaft comprises an inner wall that defines a bore. An actuator is positioned within the bore. The actuator comprises at least two actuator portions that are rotatable within the bore of the camshaft. The at least two actuator portions are joined end to end at a coupling location. A protrusion extends axially outward of a first end of each of the at least two actuator portions. Each protrusion is radially offset from a rotational axis of the corresponding actuator portion. A driving unit is mechanically coupled to the actuator and is adapted to rotate the actuator relative to the camshaft. At least two pin holes extend at least partway through the camshaft. The pin holes are positioned proximate the coupling location of the actuator and extend transversely across the camshaft. A pin is positioned in each of the at least two pin holes. The pins are adapted to open a valve. The pins comprise an axial direction and are moveable in the axial direction relative to the camshaft. The pins further comprise a recessed portion positioned within the bore of the camshaft. Each of the protruding portions of the at least two actuator portions is positioned within a corresponding one of the recesses of the pins such that the recess and the protrusion define a cam mechanism that converts rotational movement of the actuator to translating movement of the pins.

Another aspect of the present invention involves an engine comprising a decompression mechanism. The engine comprises a camshaft. The camshaft is generally hollow and has an inner wall that defines a bore that extends in an axial direction of the camshaft. A first cross hole and a second cross hole extend in a radial direction of the camshaft. The camshaft also comprises a first cam lobe and a second cam lobe. An actuator extends within the bore. The actuator comprises a first portion and a second portion. The first portion has a first portion first end and a first portion second end. The second portion has a second portion first end and a second portion second end. The first portion second end is mechanically coupled to the second portion first end. A first pin is positioned within the first cross hole and is positioned between the first portion second end and the second portion first end. The first pin is mechanically coupled to at least one of the first portion or the second portion.

A further aspect of the present invention involves an engine comprising a decompression mechanism. The engine comprises a camshaft. The camshaft is generally hollow and has an inner wall that defines a bore that extends in an axial direction of the camshaft. A first cross hole and a second cross hole extends in a radial direction of the camshaft. A first pin is positioned within the cross hole and adapted for movement in and out of the first cross hole. A second pin is positioned within the cross hole and adapted for movement in and out of the second cross hole. The camshaft also comprises a first cam lobe and a second cam lobe. The first and second pin are positioned respectively adjacent to the first and second cam lobes. An actuator extends within the bore and is capable of rotational movement relative to the camshaft. Mean are provided for transforming rotation of the actuator relative to the camshaft into bidirectional translation of the first and second pins such that relative rotation in a first direction drives translation in a first direction and relative rotation in a second direction drives translation in a second direction.

BRIEF DESCRIPTION OF THE DRAWINGS

These and other features, aspects and advantages of the present invention will now be described with reference to certain drawings of two preferred embodiments of the present invention, which drawings comprise

DETAILED DESCRIPTION OF THE PREFERRED EMBODIMENTS

With reference now to FIGS. 1 through 9, an engine is illustrated having a decompression mechanism arranged and configured in accordance with certain features, aspects and advantages of the present invention. While the illustrated engine features a two cylinder construction, it will be apparent that certain features, aspects and advantages of the present invention may find utility in engines having as few as one cylinder and more than two cylinders. Moreover, as will be explained, the illustrated engine features pistons that operation about 180 degrees out of phase, but certain features, aspects and advantages of the present invention can be used with engines in which the pistons operate 360 degrees out of phase or any other suitable configuration.

Figure 1:
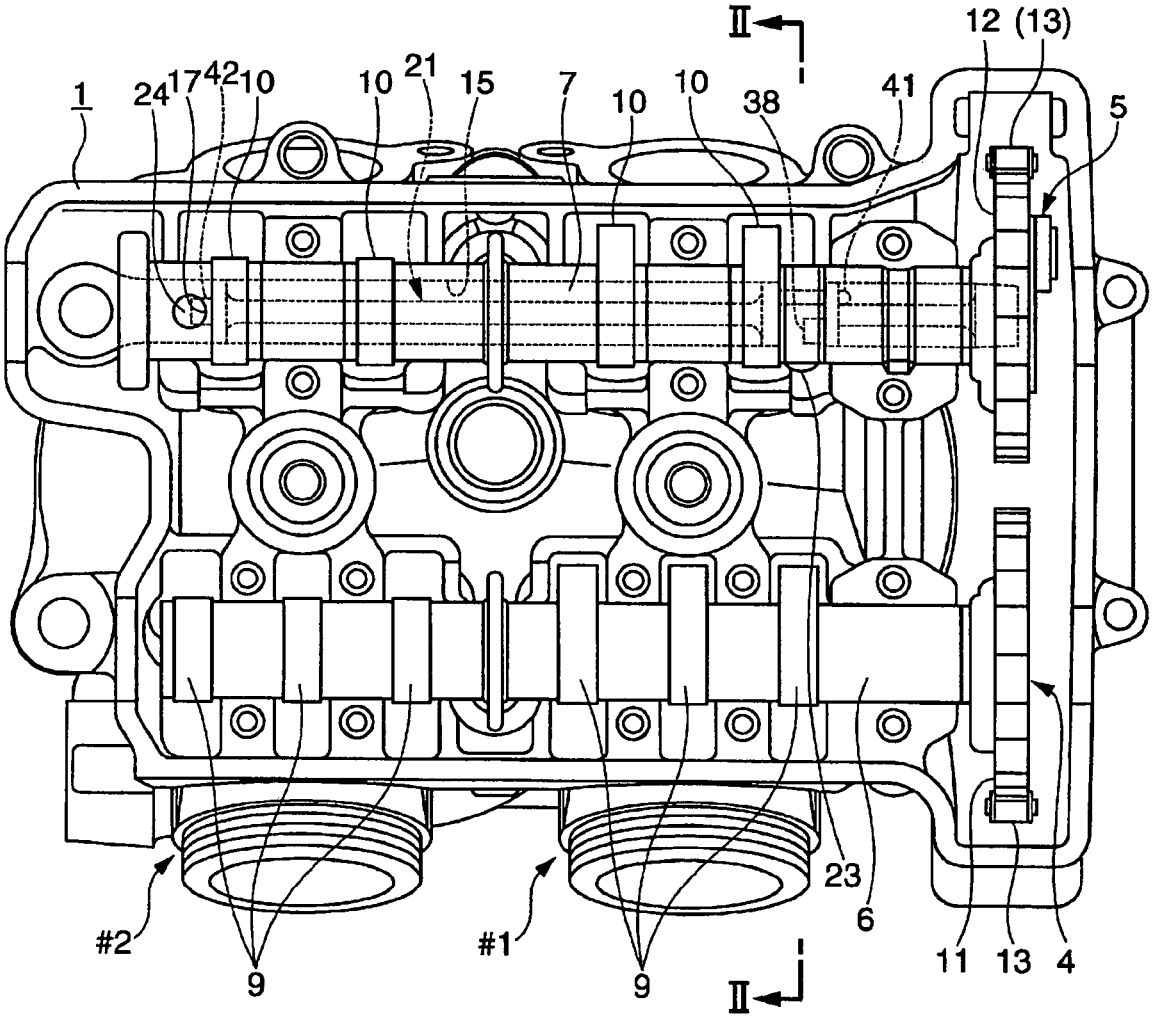
FIG. 1 is a plan view of a cylinder head of an engine equipped with a decompression mechanism arranged and configured in accordance with certain features, aspects and advantages of the present invention.

With reference to FIG. 1, the illustrated engine features a pair of cylinders that are mounted in line with each other. The cylinders are closed at a top end by a cylinder head 1. The cylinder head 1 can comprise any suitable configuration. In the illustrated embodiment, the cylinder head comprises three intake valves 2 and two exhaust valves 3 per cylinder.

Figure 2:
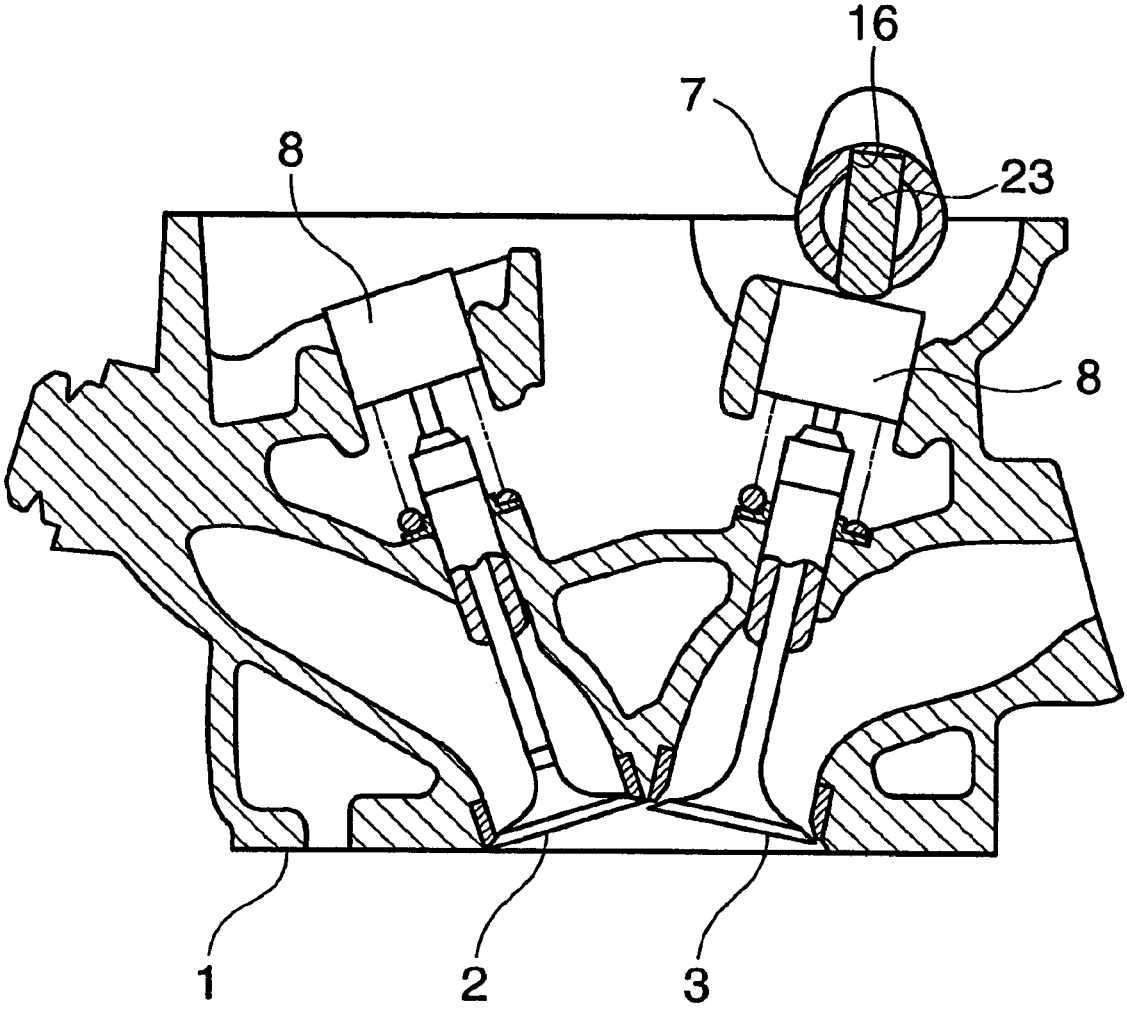
FIG. 2 is a sectional view taken along the line II—II of the cylinder head in FIG. 1.

A valve system 4 is constructed in such a way as to open or close the intake valves 2 and the exhaust valves 3. In particular, an intake camshaft 6 operates the intake valves 2 and an exhaust cam shaft 7 operates the exhaust valves 3. As shown in FIG. 2, the intake valve 2 and the exhaust valve 3 comprise a bucket tappet design that is contacted by from a cam 9 (best shown in FIG. 1) of the intake camshaft 6 or a cam 10 of the exhaust camshaft 7. In particular, as shown in FIG. 2, the valves 2, 3 feature a tappet 8 that is intermittently contacted by the cams 9, 10 to unseat the valves 2, 3 from the associated valve seat, which opens the valves. Other suitable configurations, including constructions using push rods, rocker arms and the like, also can be used.

With reference again to FIG. 1, sprockets 11, 12 are mounted to the intake camshaft 6 and the exhaust cam shaft 7, respectively, at one end in an axial direction. For purposes of this discussion, the end of the camshafts 6, 7 bearing the sprockets 11, 12 will be referred to as the base end portion, which is located on the right side in the drawing. A timing chain 13 preferably loops around the sprockets 11, 12 and transmits movement of the crankshaft to the sprockets.

As discussed above, the crankshaft preferably is a so-called 180° crank and is constructed in such a way that when a piston of one cylinder of this engine is located at about top dead center, a piston of the other cylinder is located at about bottom dead center. Thus, the cams 9, 10 of the intake camshaft 6 and the exhaust camshaft 7 of one cylinder preferably are formed about 90° out of phase relative to the other cylinder, when viewed from the axial direction of the camshaft, from the cams 9, 10 of the intake camshaft 6 and the exhaust camshaft 7 of the other cylinder.

Figure 3:
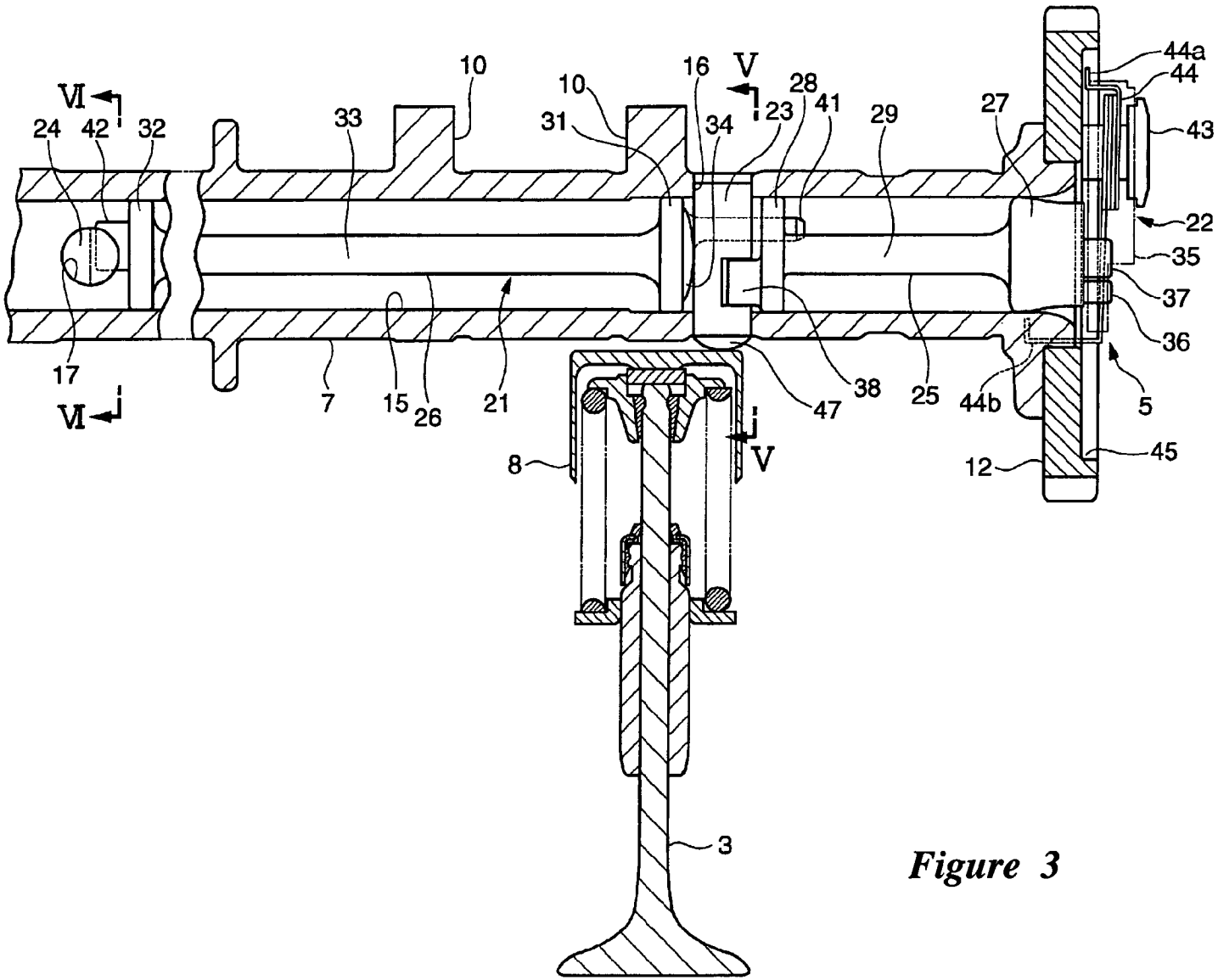
FIG. 3 is a longitudinal sectional view of the decompression mechanism used in the engine of FIG. 1.

With reference to FIG. 3, the exhaust camshaft 7 has an axial through bore 15 such that the exhaust camshaft 7 is generally hollow. With additional reference to FIG. 1, first and second pin holes 16, 17 through which pins of a decompression mechanism 5 extend are formed near the cam 10 of the illustrated exhaust camshaft 7. These first and second pin holes 16, 17 preferably are positioned along the exhaust camshaft 7 and extend transversely across the cross section of the exhaust camshaft 7.

Figure 5:
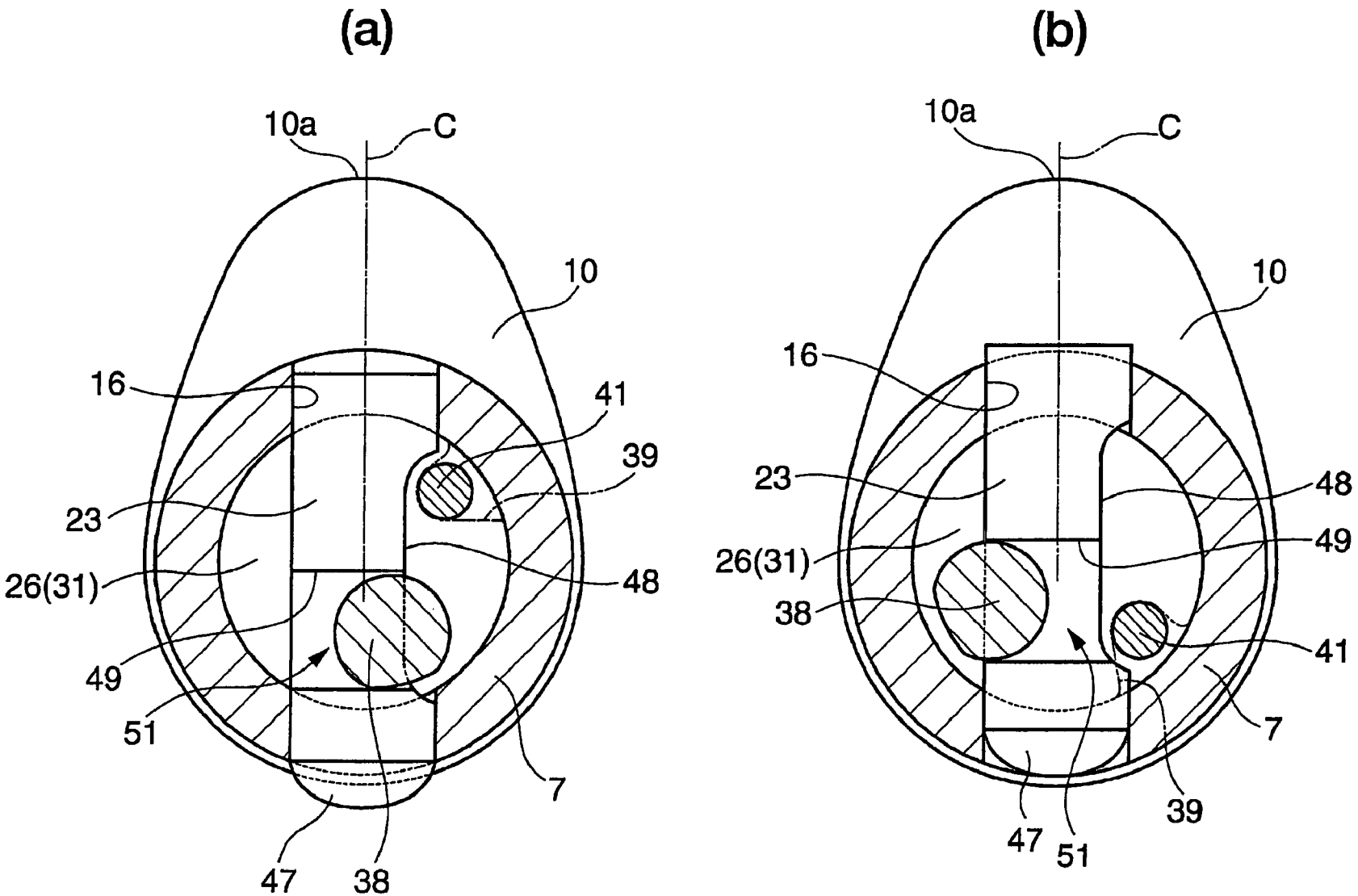
FIG. 5(*a*) and FIG. 5(*b*) are sectional views that illustrate the movement of a first decompressor pin.
Figure 6:
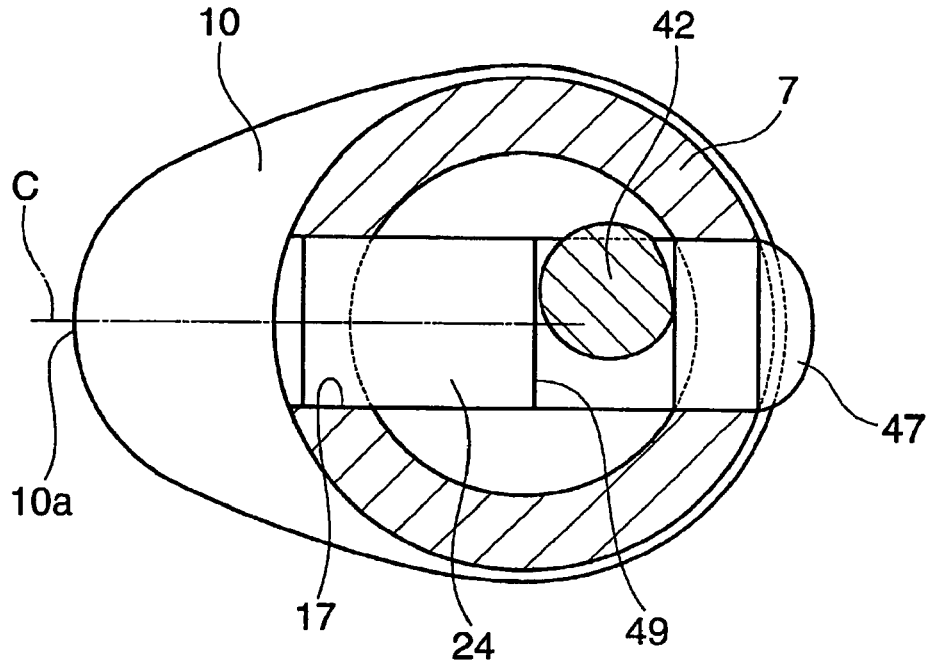
FIG. 6(*a*) and FIG. 6(*b*) are sectional views that illustrate the movement of a second decompressor pin.
Figure 6:
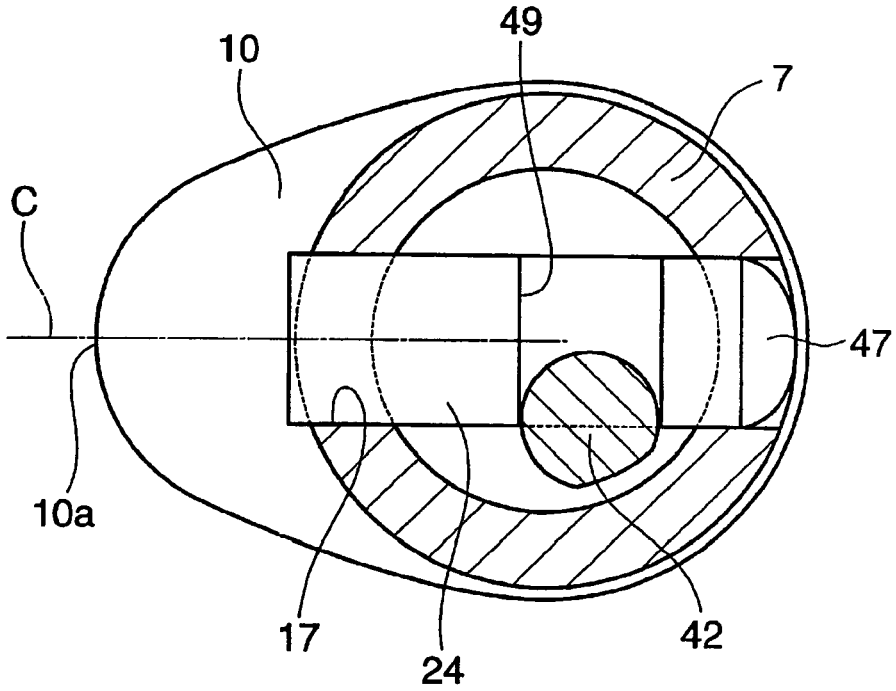

The first pin hole 16 is formed at a position that is generally adjacent to the cam 10 closest to the base end portion of the exhaust camshaft 7. More particularly, the first pin hole 16 is positioned closer to the base end portion than the cam 10 (i.e., the pin hole is interposed between the first cam 10 and the end closest to the first cam 10). The second pin hole 17 is formed at a position generally adjacent to the cam 10 closest to the opposite end portion (i.e., the end portion opposite to the above-mentioned base end portion) of the exhaust camshaft 7. More particularly, the second pin hole 16 is positioned closer to the opposite end than the cam 10 (i.e., the second pin hole is interposed between the last cam 10 and the end closest to the last cam 10). Moreover, as shown in FIG. 5 and FIG. 6, these pin holes 16, 17 preferably are formed in parallel with a center line C connecting the axis of the exhaust camshaft 7 and the crest 10*a* of the cam 10 when viewed from the axial direction of the exhaust camshaft 7. Other configurations also are possible keeping in mind the goal of opening the exhaust valves during the compression stroke to vent some of the cylinder pressure during starting.

With reference now to FIG. 3, the decompression mechanism 5 preferably comprises the generally hollow exhaust camshaft 7, an actuator 21 passed through the bore 15 of the exhaust camshaft 7, a driving unit 22 mounted at the base end of the exhaust camshaft 7 and connected to the corresponding end of the actuator 21, a first decompressor pin 23 and a second decompressor pin 24 that can be coupled to the middle portion and the opposite end of this actuator 21, respectively.

Figure 7:
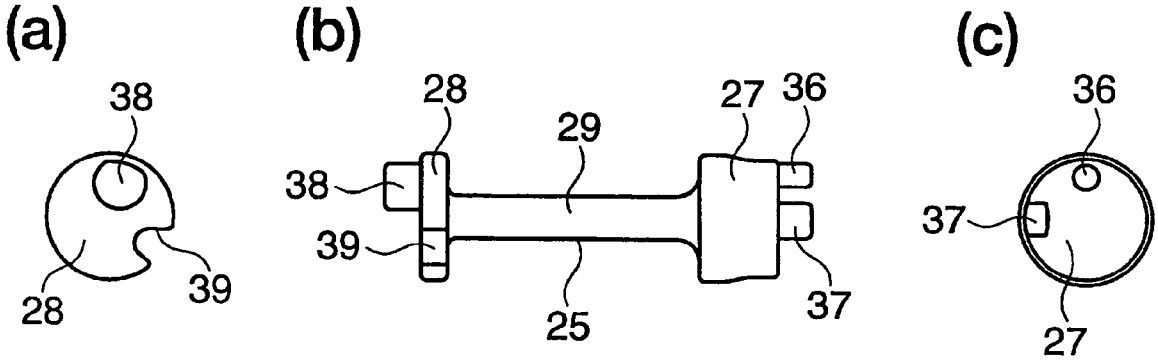
FIG. 7(*a*), FIG. 7(*b*) and FIG. 7(*c*) are three views of a first actuation shaft portion.

The illustrated actuator 21 preferably is formed of a first actuator portion 25 and a second actuator portion 26, which together define a shaft. The first actuator portion 25 preferably is positioned within the base end portion of the exhaust camshaft 7 as shown in FIG. 7. The first actuator portion 25 can have any suitable configuration. In the illustrated embodiment, the first actuator portion 25 comprises a generally circular cylindrical portion 27 located at one end (i.e., the end on the base end potion side of the exhaust camshaft 7), a generally circular plate portion 28 located at the other end portion, and a small-diameter rod-like portion 29 that connects the cylindrical portion 27 and the circular plate portion 28. In one configuration, the three portions 27, 28, 29 can be integrally formed.

Figure 8:
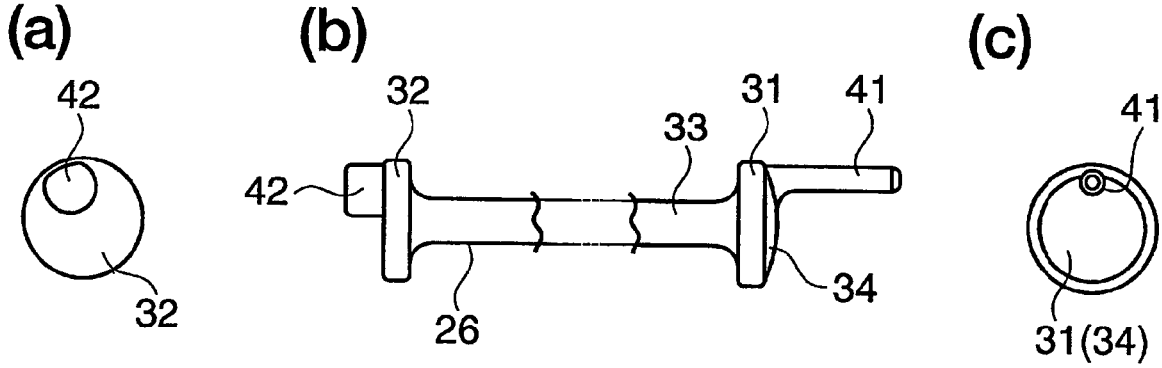
FIG. 8(*a*), FIG. 8(*b*) and FIG. 8(*c*) are three views of a second actuation shaft portion.

The illustrated second actuator portion 26, as best shown in FIG. 8, can comprise generally circular plate portion 31, 32 at both ends with a small-diameter rod-like portion 33 that connects the two plate portions 31, 32. In one configuration, the three portions 31, 32, 33 can be integrally formed. Other configurations also are practicable.

The outside diameters of the generally cylindrical portion 27 and the plate portions 28, 31, 32 of these first and second actuator portions 25, 26 preferably are formed in such a way that the first and second actuator portions 25, 26 are rotatable within the bore 15 of the exhaust shaft 7. Moreover, the peripheral portions of these portions 27, 28, 31, 32 preferably are formed with a generally spherical shape or profile. The generally spherical profile allows reduced contact surface area between the inner wall of the bore 15 and the peripheral portions. The generally spherical shape increases the allowable range of angles that the axes of the first and second actuator portions 25, 26 can be inclined with respect to the axis of the bore 15. In other words, even if the axis of the bore 15 may be deformed or bent in the middle, the first and second actuator portions 25, 26 can be precisely turned in the bore 15. As a result, the manufacturability of the bore 15 of the exhaust camshaft 7 is improved.

Furthermore, the end surface of the circular plate 31 of the one end portion of the second actuator portion 26 preferably comprises a generally spherical shape that is convex toward the circular plate 28 of the first actuator portion 25. The end surface formed in this spherical shape is identified by a reference numeral 34 in FIG. 3 and FIG. 8.

The first and second actuator portions 25, 26 are advantageously formed of rods 29, 33 whose outside diameter is smaller in the central portion in the axial direction than at both end portions. Hence, the first and second actuator portions 25, 26 have only the end portions supported in the hollow portion of the exhaust camshaft 7. Thus, both of the end portions of the first and second actuator portions 25, 26 and such portions in the hollow portion of the exhaust camshaft 7 that support both of these end portions, are formed with tight tolerances while the other portions (e.g., the rods 29, 33 of the first and second actuator portions 25, 26 and the hollow portion of the exhaust camshaft 7 located in the vicinity of the rods 29, 33) can be formed with looser tolerances. Therefore, manufacturability is improved and cost is reduced as compared with a construction in which the whole of the first and second actuator portions 25, 26 and the hollow portion of the exhaust camshaft 7 must be formed with tight tolerances. Moreover, because the central portions of the first and second actuator portions 25, 26 in the axial direction are formed in more slender shapes than at both end portions-thereof, the weight of the portions 25, 26 can be reduced.

A driving pin 36 to be coupled to a centrifugal weight 35 (refer to FIG. 4) of the driving unit 22, which will be described later, and a stopper 37 for determining the initial position of the centrifugal weight 35 are provided in such a manner as to protrude outward in the axial direction on the above-mentioned circular cylinder 27 of the first actuator portion 25. An eccentric protruding portion 38 to be coupled to the first decompressor pin 23, which will be described later, protrudes outward in the axial direction from the plate portion 28 at the other end portion of the first actuator portion 25, and a groove 39 (shown in FIG. 7A) for coupling with the second actuator portion 26 is formed in the plate portion 28.

The above-mentioned driving pin 36 and eccentric protruding portion 38 are provided at eccentric positions on the end surfaces of the first actuator portion 25. In the illustrated arrangement, the driving pin 36 is formed in the shape of a bar that is longer in length than in outside diameter and is generally circular in cross section. The eccentric protruding portion 38 preferably is formed in the shape of a generally circular cylinder that can be shorter in length than in outside diameter. The groove 39 preferably extends through the thickness of the plate portion 28 and extends inward in a radial direction from the outer peripheral surface of the plate portion 28.

This first actuator portion 25, as shown in FIG. 3, preferably is formed in such a length in the axial direction that one end portion (i.e., the right end portion in FIG. 3) of the first actuator portion 25 is located at a position generally corresponding to the first pin hole 16 of the exhaust camshaft 7 when the other end portion thereof is located generally adjacent to the base end portion of the exhaust camshaft 7.

With reference to FIG. 3 and FIG. 8, a coupling pin 41 for coupling this second actuator portion 26 to the first actuator portion 25 is provided at one end of the second actuator portion 26, and an eccentric protruding portion 42 to be coupled to the second decompressor pin 24 is formed on the other end of the second actuator portion 26. The coupling pin 41 and the eccentric protruding portion 42 are provided at eccentric positions on the end surfaces of the second actuator portion 26. The above-mentioned coupling pin 41 preferably is formed in the shape of a bar that is longer in length than in outside diameter and preferably is circular in cross section. The eccentric protruding portion 42 preferably is formed in the shape of a generally circular cylinder that may be shorter in length than in outside diameter. The outside diameter of this coupling pin 41 preferably is formed in such a way as to be able to be engaged with the above-mentioned groove 39 of the first actuator portion 25.

This second actuator portion 26, as shown in FIG. 3, preferably has an axial length such that one end portion of the second actuator portion 26 is positioned to generally correspond with the second pin hole 17 of the exhaust camshaft 7 when the coupling pin 41 on the other end portion thereof is engaged with the groove 39 of the first actuator portion 25 and when the first decompressor pin 23 is sandwiched between the second actuator portion 26 and the plate portion 28 of the first decompressor shaft 21.

Figure 4:
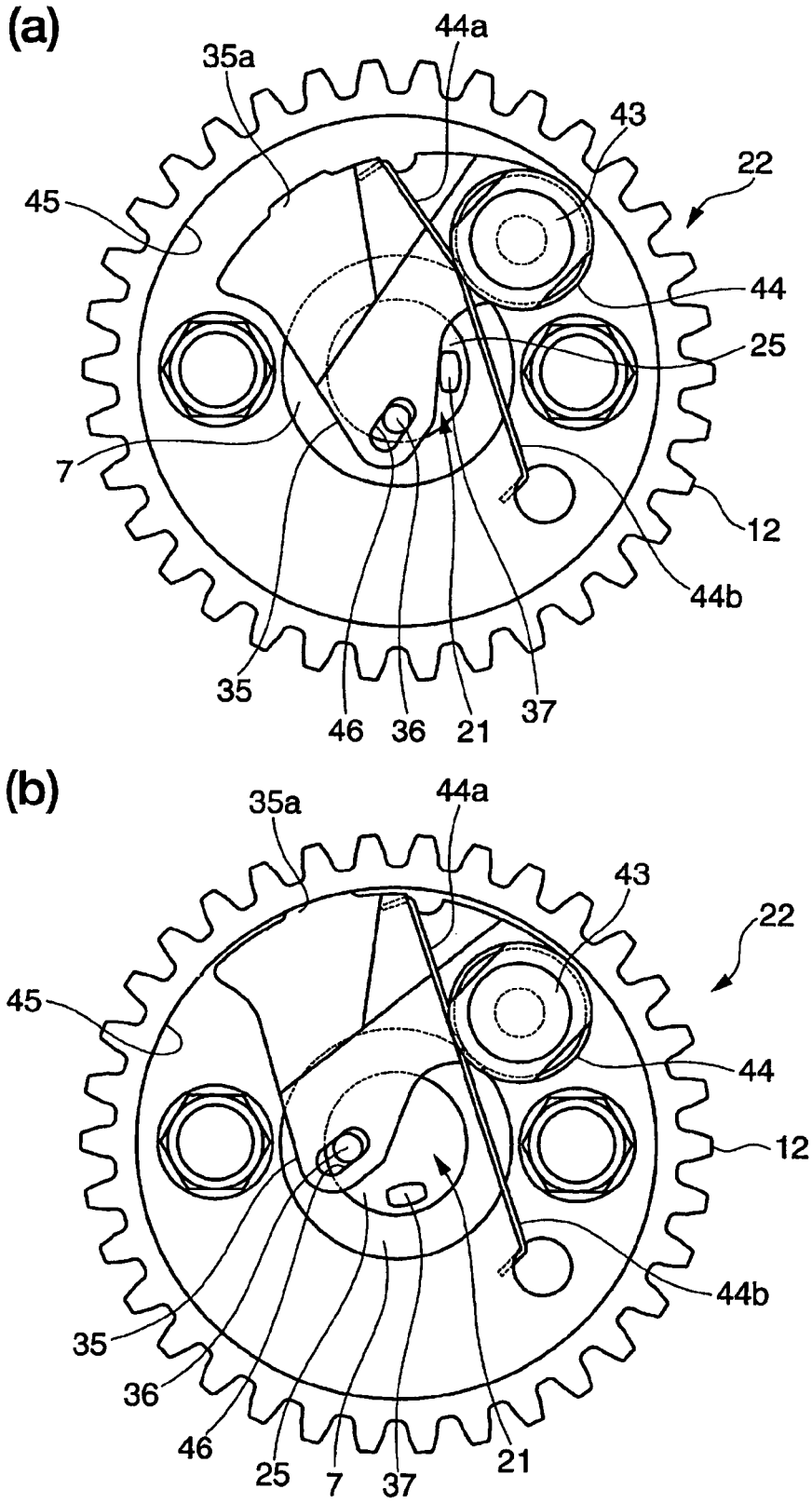
FIG. 4(*a*) and FIG. 4(*b*) are front views of a driving unit used in the engine of FIG. 1 with FIG. 4(*a*) showing a centrifugal weight in an initial position and FIG. 4(*b*) showing the centrifugal weight in a high speed rotation position.

As shown in FIG. 3 and FIG. 4, the driving unit 22 preferably comprises the centrifugal weight 35, which is pivotally supported on the sprocket 12 of the exhaust camshaft 7 by a support shaft 43, and a return spring 44, which also is secured by the support shaft 43. Other arrangements also can be used. For instance, the driving unit 22 can be mounted on other components other than the sprocket 12. In the illustrated arrangement, however, the supporting shaft 43 is provided at an eccentric position on the sprocket 12.

The centrifugal weight 35, as shown in FIG. 4, preferably is formed in a generally triangular shape when viewed from the axial direction of the exhaust camshaft 7. Moreover, the illustrated centrifugal weight 35 is housed in a circular depressed portion 45 formed on the outer end surface of the sprocket 12. Other positions also are possible, although the illustrated configuration is advantageously compact.

The centrifugal weight 35 preferably is constructed in such a way as to turn clockwise around the supporting shaft 43 with respect to the sprocket 12 in FIG. 4 by a centrifugal force produced when the centrifugal weight 35 rotates integrally with the exhaust camshaft 7. A side portion 35*a* of the illustrated centrifugal weight 35 generally opposes the peripheral wall surface of the circular depressed portion 45. Preferably, the side portion 35*a* is formed with an arcuate shape that is complementary to the peripheral wall. More preferably, the peripheral wall acts as a stop to limit outward rotation of the centrifugal weight 35. As shown in FIG. 4A, this portion 35*a* formed in the shape of an arc abuts against the above-mentioned peripheral wall to thereby prevent the centrifugal weight 35 from being moved further outward by centrifugal force.

An elongated hole 46, or slot, which is engaged by the above-mentioned driving pin 36 of the first actuator portion 25, preferably is formed on the other side of the centrifugal weight 35 in the rotational direction. The slot 46 facilitates rotation of the actuator 21 when the centrifugal weight 35 rotates about the shaft 43.

The above-mentioned return spring 44 preferably is formed of a torsion spring, with a first portion 44*a* engaged with a recess formed in the peripheral wall of the centrifugal weight 35 and a second portion 44*b* engaged with an opening in the above-mentioned sprocket 12. The spring 44 urges the centrifugal weight 35 counterclockwise in FIG. 4. As shown in FIG. 4A, the centrifugal weight 35, under the influence of the return spring 44, abuts against the above-mentioned stopper 37, which protrudes from the first actuator portion 25. Thus, the first position of the centrifugal weight is defined by the stopper 37.

When the rotational speed of the exhaust camshaft 7 is lower than a predetermined speed, the centrifugal weight 35 of this driving unit 22 is held at the first position (e.g., that shown in FIG. 4A) by the biasing force of the return spring 44. When the rotational speed of the exhaust camshaft 7 increases above the predetermined speed, the centrifugal force applied to this centrifugal weight 35 increases and, as shown in FIG. 4B, the centrifugal weight 35 swings clockwise with respect to the sprocket 12 against the resilient force of the returning spring 44. When the centrifugal weight 35 swings outward, the position of the elongated hole 46 is changed and the first actuator portion 25 is turned with respect to the exhaust camshaft 7.

Thus, the first actuator portion 25 is turned is clockwise, as shown in FIG. 4(*b*). The second actuator portion 26 is coupled to the first actuator portion 25 in such a way as to be operatively connected to the same via the above-mentioned coupling pin 41. Hence, when the first actuator portion 25 is turned as described above, the second actuator portion 26 is also turned in the same way. That is, the actuator 21 of the exhaust camshaft 7 is located at the initial position 5 when the engine stops, and is turned clockwise in the drawing immediately after cranking is started, and is held at a normal driving position shown in FIG. 4B when the engine starts.

Moreover, in the decompression mechanism 5, the actuator 21 is provided along the axis of the exhaust camshaft 7 and the coupling of the first actuator portion 25 to the second actuator portion 26 can be effected by a relatively slender coupling pin 41, which reduces the likelihood of contact with the first decompressor pin 23. Hence, it is possible to increase the degree of flexibility in setting the angle of the decompressor pin when viewed from the axial direction of the exhaust camshaft 7. That is, although the crankshaft of the engine according to this embodiment is a so-called 180° crank, as described above, the crankshaft is not subject to constraints in the angles of the decompressor pins 23, 24. Therefore, it is also possible to easily adopt the mechanism 5 to a 360° crank (type in which the pistons of two cylinders move in the same direction) for the crankshaft.

As shown in FIG. 5 and FIG. 6, each of the first and second decompressor pins 23, 24 is generally cylindrical and has a length nearly equal to the outside diameter of the exhaust camshaft 7. The pins 23, 24 are movably fitted in the corresponding first pin hole 16 or the second pin hole 17 of the exhaust camshaft 7. Each of these decompressor pins 23, 24 is located near one of the cams 10 and an end of each of the pins 23, 24 selectively protrudes from the pin holes 16, 17, such that the pins can contact with the valve lifters 28, or tappets, of the exhaust valves 3. In particular, in the illustrated decompression mechanism 5, the first and second pins 23, 24 open the exhaust valves 3 during at least a portion of the compression stroke to thereby reduce compression pressure.

Preferably, the end portions of the pins 23, 24 that protrude from the pin holes 16, 17 are positioned generally opposite to the crests 10*a* of the corresponding cams 10 when viewed in the axial direction (e.g., as shown in FIG. 5 and FIG. 6). Thus, as described above, the exhaust valves 3 can be opened in the compression stroke by the pins 23, 24.

In this case, the crest 10*a* of the cam 10 for the exhaust valve of one cylinder is located at the bottom side in FIG. 6 and hence the second decompressor pin 24 protrudes upward from the second pin hole 17 in FIG. 6 while the other pin 24 protrudes downward from the first pin hole 16. In a conventional decompression system, it is not believed possible to adopt a construction in which two decompressor pins move in two opposing directions, such as that accomplished in the present decompression mechanism 5.

The end surfaces of the pins 23, 24 that contact the valve lifters 8 comprise a generally spherical shape so as to reduce frictional resistances when they contact the valve lifters 8. The end surfaces formed in these spherical shapes are indicated by reference numeral 47 in FIG. 3 and FIG. 9.

Figure 9:
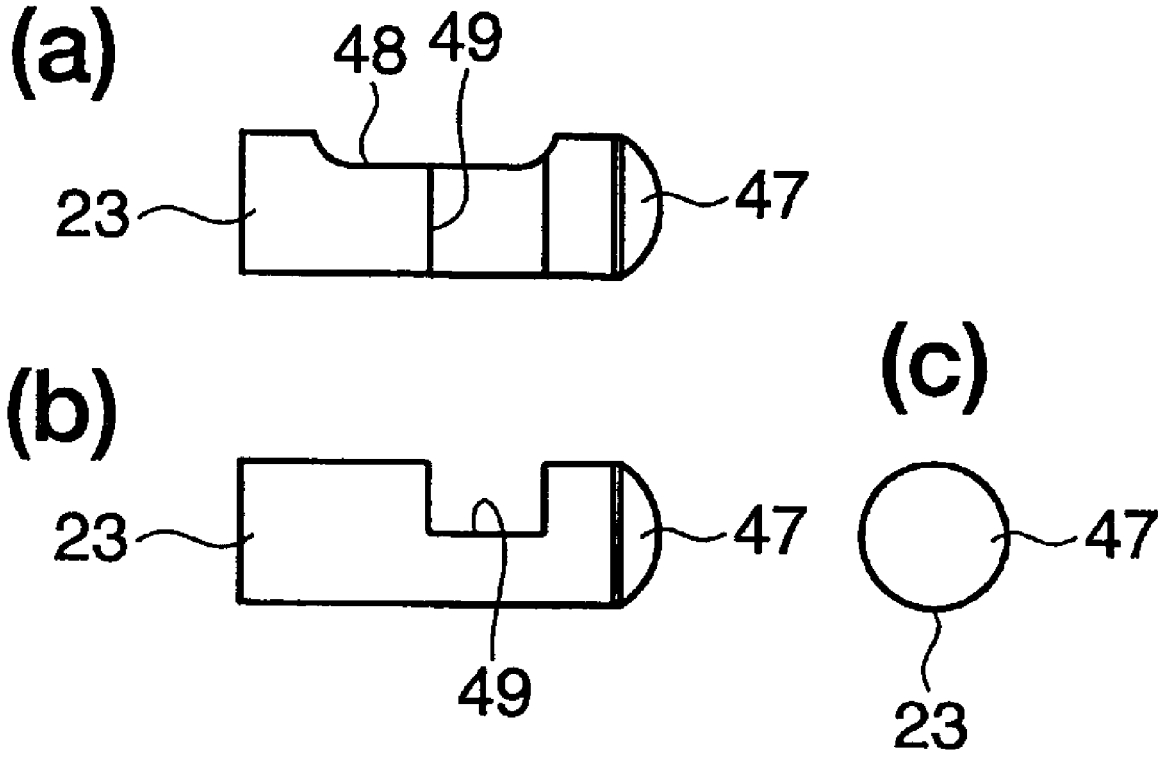
FIG. 9(*a*), FIG. 9(*b*) and FIG. 9(*c*) are three views of the first decompressor pin.

With reference to FIG. 5 and FIG. 9, an axial cutout 48 extends through a portion of the periphery of the first pin 23. The cutout 48 advantageously reduces the likelihood of contact with the coupling pin 41. In some configurations, the sizing of the components can be adjusted. With continued reference to FIG. 9, in the axial middle of the first decompressor pin 23 and in the axial middle of the second decompressor pin 24, there preferably are formed recessed portions 49. The eccentric protruding portions 38, 42 of the first and second actuator portions 25, 26 engaged the recessed portions 49 of the corresponding pins 23, 24. The recessed portions 49 preferably are grooves that extend through the peripheral portions of the first and second decompressor pins 23, 24 in a direction generally orthogonal to the axial direction of the exhaust camshaft 7. These recessed portions 49 are formed in such a way that the diameter of each the groove is slightly larger than the outside diameter of the corresponding protruding portion 38, 42.

The recessed portions 49 and the protruding portions 38, 42 define a cam mechanism 51 that converts the turning motion of the actuator 21 into reciprocating motion for each of the first and second pins 23, 24. That is, when the actuator 21 is turned with respect to the exhaust camshaft 7 to move the eccentric protruding portions 38, 42 from the initial positions shown in FIG. 5A or FIG. 6A to the normal driving positions shown in FIG. 5B or FIG. 6B, the rotational movement is converted into reciprocating movement through the cam mechanism 51, whereby the first and second decompressor pins 23, 24 are extended from and retracted into the camshaft 7. Thus, when the actuator 21 is turned, the first and second decompressor pins 23, 24 are forcibly moved by the cam mechanism 51. Hence, the positions of both the first and second pins 23, 24 can be synchronized. As a result, the engine provided with the decompression mechanism 5 develops more uniform combustion in each cylinder during engine starting and, as such, starts more efficiently and stably.

In an engine equipped with the decompression mechanism 5 shown in this embodiment, it is possible to reduce force necessary for cranking because compression pressure is reduced when the engine is started and hence to use a starter motor that is reduced in power, size, and weight. Moreover, because the power consumption of the starter motor is reduced in this manner, it is also possible to use a battery that is reduced in charging capacity, size, and weight.

Moreover, in the illustrated decompression mechanism 5, the end surface 34 of the circular plate 31 of the second actuator portion 26 adjoining to the first decompressor pin 23 has a generally spherical shape that is convex toward the first decompressor pin 23. Thus, the first decompressor pin 23 is put in point contact with the second actuator portion 26 to reduce frictional resistance when the first decompressor pin 23 moves in a sliding manner with respect to the second actuator portion 26. As a result, the first decompressor pin 23 is adapted to smoothly reciprocate between the pressing position and the non-pressing position.

Figure 10:
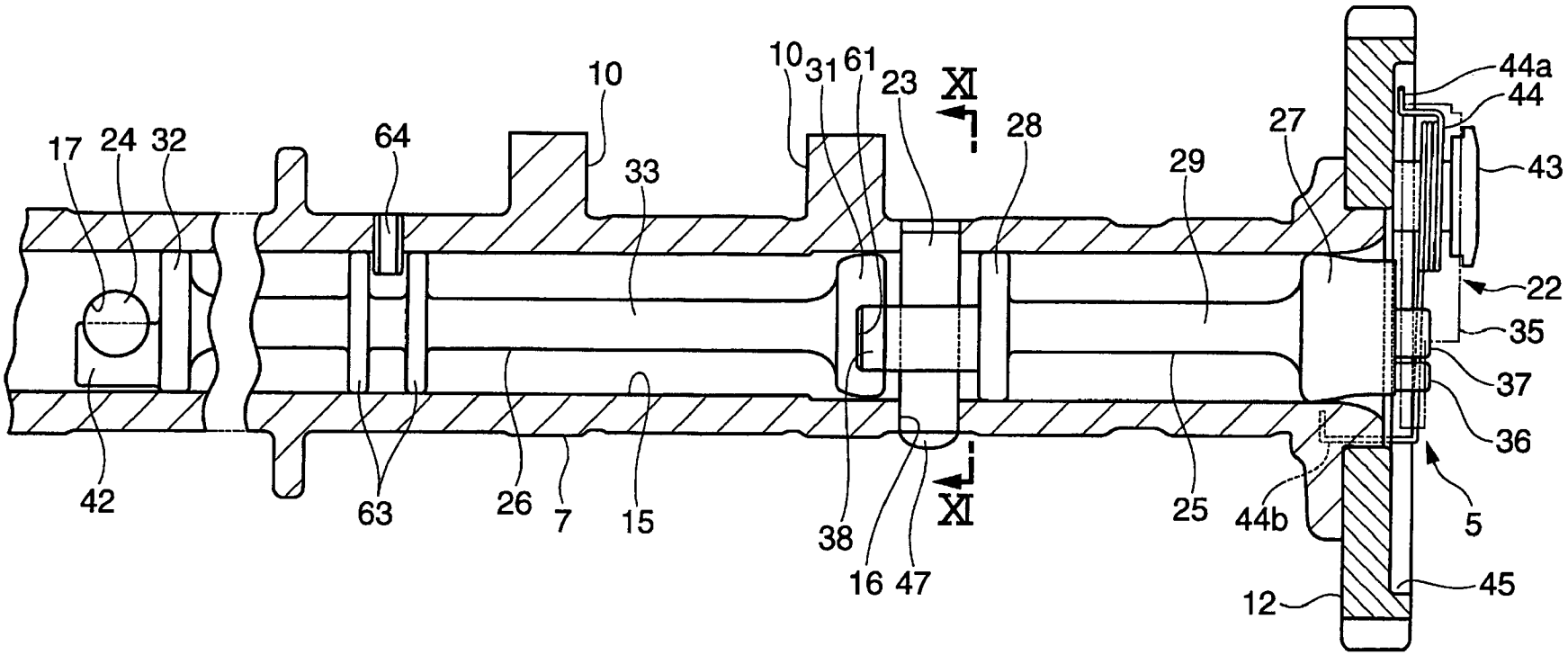
FIG. 10 is a longitudinal sectional view of another decompression mechanism that can be used with an engine such as that shown in FIG. 1.
Figure 11:
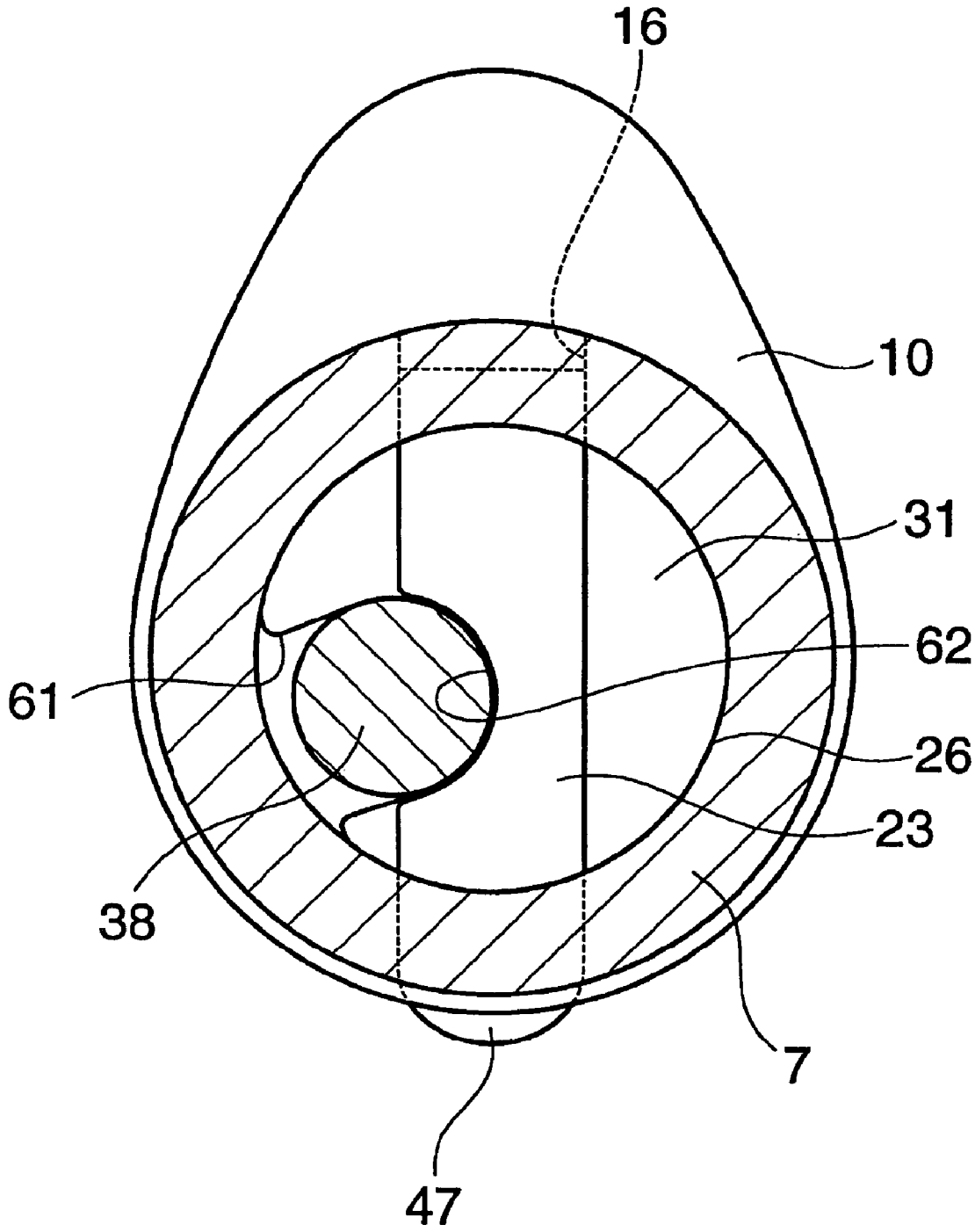
FIG. 11 is a sectional view taken along the line XI—XI in FIG. 10.

With reference now to FIGS. 10 and 11, another configuration is illustrated that is arranged and configured in accordance with certain features, aspects and advantages of the present invention. As illustrated, another actuator construction also can be used and another embodiment of a decompressor pin also can be used. In the following description, the same or equivalent parts as described in FIGS. 1 to 9 will be denoted by the same reference symbols and detailed descriptions of those components will be omitted unless desired or needed for understand of the illustrated embodiment.

The eccentric protruding portion 38 of the first actuator portion 25 shown in FIG. 10 and FIG. 11 is longer in the axial direction as compared with that of the first embodiment. The protruding end portion of this eccentric protruding portion 38 is coupled to the generally circular plate 31 of the second actuator portion 26. In this coupling portion, as shown in FIG. 11, the tip portion of the eccentric protruding portion 38 preferably is movably received within an engaging groove 61 of the generally circular plate 31. Thus, the torque is transmitted from the first actuator portion 25 to the second actuator portion 26 via the eccentric protruding portion 38.

By use of this coupling structure, as shown in FIG. 11, the coupling of the first decompressor pin 23 to the eccentric protruding portion 38 is effected by forming a recessed portion 62, which is defined by a groove or the like and which extends in the axial direction of the exhaust camshaft 7. In the illustrated configuration, the recessed portion is generally semi-circular in cross section and provided on the outer peripheral portion of the first pin 23. Other suitable shapes and forms also can be used so long as the eccentric protruding portion 38 can be received within this recessed portion 62.

The second actuator portion 26 preferably has a pair of positioning plates 63 provided along its central portion in the axial direction. The plates 63 can be circular in some configuration. Other shapes also can be used. The plates 63 are provided in such a way as to sandwich a positioning pin 64, which is fixed to the exhaust camshaft 7. The pin can be a set screw or the like. In this manner, the second actuator portion 26 can be positively located within the exhaust camshaft 7.

In a structure such as that shown in FIGS. 10 and 11, the coupling pin 41 of the first construction is eliminated. Thus, the second construction provides a simplified construction and eases manufacturing.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned as desired. It also is possible to adopt, as the driving unit (e.g., in place of, or along with, the return spring and the centrifugal weight), a construction in which the actuator 21 is turned by, for example, hydraulic pressure, an electric motor, a solenoid or the like, or by a manual operation. Moreover, not all of the features, aspects and advantages are necessarily required to practice the present invention. Accordingly, the scope of the present invention is intended to be defined only by the claims that follow.

What is claimed is:

1. An engine with a decompression mechanism, the engine comprising a generally hollow camshaft, said camshaft comprising an inner wall that defines a bore, an actuator positioned within said bore, said actuator comprising at least two actuator portions that are rotatable within said bore of said camshaft, said at least two actuator portions being joined end to end at a coupling location, a protrusion extending axially outward of a first end of each of said at least two actuator portions, each said protrusion being radially offset from a rotational axis of said corresponding actuator portion, a driving unit mechanically coupled to said actuator and adapted to rotate said actuator relative to said camshaft, at least two pin holes extending at least partway through said camshaft, said pin holes being positioned proximate said coupling location of said actuator and extending transversely across said camshaft, a pin positioned in each of said at least two pin holes, said pins being adapted to open a valve, said pins comprising an axial direction and being moveable in said axial direction relative to said camshaft, said pins further comprising a recessed portion positioned within said bore of said camshaft, each of said protruding portions of said at least two actuator portions being positioned within a corresponding one of said recesses of said pins such that said recess and said protrusion define a cam mechanism that converts rotational movement of said actuator to translating movement of said pins.

2. The engine of claim 1, wherein one end of one of said at least two actuator portions comprises a generally convex spherical configuration, said one end being positioned adjacent to one of said pins.

3. The engine of claim 2, wherein said at least two actuator portions are joined by a coupling pin, said coupling pin being formed by said protruding portion of one of said actuator portions, said protruding portion also being engaged with said recessed portion of said pin.

4. The engine of claim 3, wherein at least one of said at least two actuator portions has a small-diameter shaft portion that is formed in an axially central portion thereof, said shaft portion having an outer diameter smaller than an outer diameter of both end portions of said at least one of said at least two actuator portions.

5. The engine of claim 4, wherein outer peripheral portions of both end portions have a generally spherical shape.

6. The engine of claim 1, wherein said at least two actuator portions are joined by a coupling pin, said coupling pin being formed by said protruding portion, which also is engaged with the recessed portion of said pin.

7. The engine of claim 6, wherein at least one of said at least two actuator portions has a small-diameter shaft portion that is formed in an axially central portion thereof, said shaft portion having an outer diameter smaller than an outer diameter of both end portions of said at least one of said at least two actuator portions.

8. The engine of claim 1, wherein at least one of said at least two actuator portions has a small-diameter shaft portion that is formed in an axially central portion thereof, said shaft portion having an outer diameter smaller than an outer diameter of both end portions of said at least one of said at least two actuator portions.

9. An engine comprising a decompression mechanism, the engine comprising a camshaft, said camshaft being generally hollow and having an inner wall that defines a bore that extends in an axial direction of said camshaft, a first cross hole and a second cross hole extending in a radial direction of said camshaft, said camshaft also comprising a first cam lobe and a second cam lobe, an actuator extending within said bore, said actuator comprising a first portion and a second portion, said first portion having a first portion first end and a first portion second end, said second portion having a second portion first end and a second portion second end, said first portion second end being mechanically coupled to said second portion first end, a first pin being positioned within said first cross hole and being positioned between said first portion second end and said second portion first end, and said first pin being mechanically coupled to at least one of said first portion or said second portion.

10. The engine of claim 9, wherein said first cross hole extends completely through said camshaft.

11. The engine of claim 9, wherein said first pin comprises a transverse slot and said first portion comprises a protrusion that is received within said slot such that rotation relative to said camshaft of said first portion about said axial direction of said camshaft results in translating movement of said first pin relative to said camshaft.

12. The engine of claim 9, wherein said first cross hole is between said first cam lobe and said first portion first end.

13. The engine of claim 12, wherein said first cross hole is positioned adjacent to said first cam lobe.

14. The engine of claim 9, wherein said first portion has a reduced diameter portion located between said first portion first end and said first portion second end.

15. The engine of claim 14, wherein said second portion has a reduced diameter portion located between said second portion first end and said second portion second end.

16. An engine comprising a decompression mechanism, the engine comprising a camshaft, said camshaft being generally hollow and having an inner wall that defines a bore that extends in an axial direction of said camshaft, a first cross hole and a second cross hole extending in a radial direction of said camshaft, a first pin positioned within said cross hole and adapted for movement in and out of said first cross hole, a second pin positioned within said second cross hole and adapted for movement in and out of said second cross hole, said camshaft also comprising a first cam lobe and a second cam lobe, said first and second pin being positioned respectively adjacent to said first and second cam lobes, an actuator extending within said bore and capable of rotational movement relative to said camshaft, said actuator comprising at least two actuator portions that are rotatable within said bore of said camshaft, said at least two actuator portions being joined end to end at a coupling location, and means for transforming rotation of said actuator relative to said camshaft into bidirectional translation of said first and second pins such that relative rotation in a first direction drives translation in a first direction and relative rotation in a second direction drives translation in a second direction.

17. The engine of claim 16, wherein said first cross hole extends completely through said camshaft.

18. The engine of claim 17, wherein said second cross hole extends completely through said camshaft.

19. The engine of claim 16, wherein said means for transforming comprises a slot and a protrusion that together define a cam mechanism.

* * * * *